US005887725A

United States Patent [19]

Tominaga et al.

[11] Patent Number: 5,887,725

[45] Date of Patent: Mar. 30, 1999

[54] CLASSIFIER HAVING A ROTATABLE DISPERSION PLATE

[75] Inventors: Satoshi Tominaga, Shinogawa-machi; Shingo Mukai, Yokohama, both of Japan

[73] Assignee: Ishikawajima-Harima Jukogyo Kabushiki Kaisha, Tokyo-to, Japan

[21] Appl. No.: 724,476

[22] Filed: Oct. 1, 1996

[51] Int. Cl.[6] ..... B07B 4/00

[52] U.S. Cl. ..... 209/146; 209/139.1; 209/153; 209/710

[58] Field of Search ..... 209/133, 138, 209/139.1, 139.2, 142, 143, 146, 153, 713, 714, 710

[56] References Cited

U.S. PATENT DOCUMENTS

| | | | |
|---|---|---|---|
| 4,818,376 | 4/1989 | Tanaka et al. | 209/714 X |
| 5,024,754 | 6/1991 | Patzelt et al. | 209/135 |
| 5,232,096 | 8/1993 | Weit | 209/139.2 X |

FOREIGN PATENT DOCUMENTS

| | | | |
|---|---|---|---|
| 0 374 491 | 6/1990 | European Pat. Off. . | |
| 5-49077 | 6/1993 | Japan . | |
| 5-74682 | 10/1993 | Japan . | |
| 5285455 | 11/1993 | Japan | 209/714 |
| 6-29671 | 4/1994 | Japan . | |

OTHER PUBLICATIONS

Patent Abstracts of Japan, vol. 95, No. 4, May 31, 1995, JP–A–07 016539, Jan. 20, 1995.

Patent Abstracts of Japan, vol. 17, No. 388 (C–1086), Jul. 21, 1993, JP–A–05 068948, Mar. 23, 1993.

E. Onuma, et al., Zement–Kalk–Gips, pp. 535–543, 1994, "Separators in Grinding Circuits".

*Primary Examiner*—Tuan N. Nguyen

*Attorney, Agent, or Firm*—Oblon, Spivak, McClelland, Maier & Neustadt, P.C.

[57] ABSTRACT

A raw material is dispersed around a rotating separator main body having a plurality of classifying blades annularly arranged on the main body and is exposed on a rising flow of classifying air so as to sift off crude powder which cannot be entrained on the flow of the classifying air. The remaining raw material entrained on the classifying air is peripherally introduced into the separator main body for classification into fine and crude powders, the fine power being the powder which is allowed to pass through the classifying blades while the crude powder is the powder which is not allowed to pass. A dispersion plate is arranged between the separator main body and a raw material inlet above the separator main body to receive and disperse the raw material from the inlet. The dispersion plate is rotatable at number of revolutions different from that of the separator main body. Thus, the dispersion plate can be set at proper number of revolutions independently of number of revolutions of the separator main body required for classification.

10 Claims, 6 Drawing Sheets

CLASSIFIER HAVING A ROTATABLE DISPERSION PLATE

BACKGROUND OF THE INVENTION

The present invention relates to a classifier used in cement manufacturing facilities and the like.

FIGS. 1 and 2 show a conventional classifier. In the figures, reference numeral 1 denotes a classifier casing which comprises an upper cylindrical casing section 4 having a raw material inlet 3 for receiving a raw material 2 in a position on an upper surface of the section 4 and a lower funnel-shaped casing section 5 contiguous with a lower portion of the section 4 and having its diameter gradually reduced downwardly.

A vortex chamber 7 with a plurality of louvers 6 annularly arranged on an inner periphery of the chamber 7 is formed on and is protruded outwardly from a lower portion of the lower casing section 5. A classifying air introduction pipe 8 opened to the chamber 7 is arranged tangentially on an outer periphery of the chamber 7 (see FIG. 2).

Under the vortex chamber 7, the lower casing section 5 has a lower crude powder outlet 10 for discharging crude powder 9 falling along an inner surface of the lower casing section 5.

Reference numeral 11 designates a separator main body which is driven by a drive 12 on the upper surface of the upper casing section 4 and which is supported from above by a rotary shaft 13 rotatably supported substantially at a center of the section 4. The separator main body 11 comprises a mounting plate 15 fixed to a lower end of the rotary shaft 13, a dispersion plate 16 fixed to an upper portion of the shaft 13 to receive the raw material 2 from the inlet 3 and classifying blades 17 arranged peripherally along an outer periphery of the plate 15 and fixed between the plates 15 and 16.

Reference numeral 18 represents a fine powder hopper arranged under the separator main body 11. The fine powder hopper 18 comprises a funnel-shaped hopper main body 19 having its diameter gradually reduced downwardly and an exhaust outlet 22 extending from a lower end of the hopper main body 19 through the lower casing section 5 to outside of the section 5 so that fine powder 20 introduced via the classifying blades 17 into the separator main body 11 can be discharged outside together with classifying air 21.

When the drive 12 is actuated to rotate the separator main body 11 via the rotary shaft 13 and at the same time the classifying air 21 is introduced from the introduction pipe 8 into the vortex chamber 7 and the raw material 2 is charged by a predetermined quantity into the casing 1 through the inlet 3 on the upper surface of the casing 1, the raw material 2 thus charged falls onto the rotating dispersion plate 16 so that, with centrifugal force being given to the raw material 2, the raw material 2 is dispersed peripherally outwardly of the plate 16.

In this case, the classifying air 21 from the introduction pipe 8 into the vortex chamber 7 is given swirling force by the chamber 7 and flows into the casing 1 through the louvers 6. Thus, a flow of classifying air 21 is provided which swirls up along the inner surface of the lower casing section 5 and flows into the rotating separator main body 11 through the classifying blades 17, so that the raw material 2 falling from above onto the dispersion plate 16 is dispersed into the flow of the classifying air 21.

The raw material 2 entrained on the flow of the classifying air 21 is classified into fine and crude powders 20 and 9, the fine powder 20 being the powder which is allowed to pass through the classifying blades 17 while the crude powder 9 is the powder which is not allowed to pass. Only the fine powder 20 allowed to pass through the classifying blades 17 is guided into the separator main body 11, flows down into the hopper main body 19 of the fine powder hopper 18 and is discharged outside together with the classifying air 21 through the exhaust outlet 22.

On the other hand, the crude powder 9 which is not allowed to pass through the classifying blades 17 and is flapped onto the inner surface of the casing 1 as well as the crude powder 9 which cannot be entrained on the flow of the classifying air 21 from the beginning are away from the flow of the classifying air 21, fall down along the inner surface of the casing 1 and are discharged outside through the lower outlet 10.

In such classifier, number of revolutions of the separator main body 11 required for classification of the raw material 2 will depend on particle size distribution of the raw material 2 to be classified and is usually in a range of 100 to 1000 r.p.m. Number of revolutions of the dispersion plate 16 required for dispersion of the raw material 2 will depend on diameter of the dispersion plate 16 and amount of raw material to be supplied and is usually on the order of 10 to 100 r.p.m.

However, in the conventional classifier as shown in FIGS. 1 and 2, the dispersion plate 16, which is integrated with the separator main body 1, is rotated at the rotating speed of the separator main body 11 required for classification. As a result, the raw material which falls onto the dispersion plate 16 is scattered with centrifugal force higher than required; therefore, most of the raw material 2, which is to be entrained on the flow of the classifying air 21 and transported to the classifying blades 17 of the separator main body 11, will violently strike on and fall along the inner surface of the casing 1 without fully entrained on the flow of the classifying air 21, resulting in discharge of most of the powder as crude powder 9 without having an enough chance for classification, which disadvantageously leads to lowering of classifying efficiency. Because more quantity of powder strikes on and falls along the inner surface of the casing 1, the inner surface of the casing 1 tends to be worn out.

The present invention was made in view of the above and has its object to provide a classifier capable of preventing a centrifugal force more than required from being given to raw material to be dispersed by a dispersion plate.

BRIEF SUMMARY OF THE INVENTION

In a classifier wherein a raw material is dispersed around a rotating separator main body having a plurality of classifying blades annularly arranged thereon and is exposed on a rising flow of classifying air so as to sift off crude powder which cannot be entrained on the flow of the classifying air, the remaining raw material entrained on said classifying air being peripherally introduced into said separator main body for classification into fine and crude powders, the fine powder being the powder which is allowed to pass through the classifying blades while the crude powder is the powder which is not allowed to pass, the present invention is directed to an improvement which comprises a dispersion plate arranged between said separator main body and a raw material inlet above said separator main body for receiving and dispersing the raw material from said inlet, said dispersion plate being rotatable at number of revolutions different from that of the separator main body.

Also in a classifier wherein a raw material is dispersed around a rotating separator main body having a plurality of classifying blades annularly arranged thereon and having a plurality of stationary vanes surrounding the separator main body and is exposed on a rising flow of classifying air so as to sift off crude powder which cannot be entrained on the flow of the classifying air, the remaining raw material entrained on said classifying air being peripherally introduced through the stationary vanes into said separator main body for classification into fine and crude powders, the fine power being the powder which is allowed to pass through the classifying blades while the crude powder is the powder which is not allowed to pass, the present invention is directed to an improvement which comprises a dispersion plate arranged between said separator main body and a raw material inlet above said separator main body for receiving and dispersing the raw material from said inlet, said dispersion plate being rotatable at number of revolutions different from that of the separator main body.

In either of the above-mentioned classifiers, the dispersion plate and the separator main body can have numbers of revolutions suitable in use for them, respectively. As a result, the raw material falling from the inlet onto the dispersion plate is given adequate centrifugal force and is dispersed outside of the dispersion plate. Then, crude powder which cannot be entrained on the flow of classifying air is sifted off and the remaining raw material is properly entrained on the flow of the classifying air and is classified by the separator main body.

The dispersion plate may be supported from above by a hollow shaft and the separator main body may be supported by a rotary shaft which rotatably extends through the hollow shaft, the hollow and rotary shafts being driven by independent drives, respectively.

Alternatively, the separator main body may be supported from above by a rotary shaft driven by a drive and a dispersion plate may be rotatably fitted over an intermediate portion of the rotary shaft at a position above the separator main body, a speed reducing mechanism for reducing rotating speed given to the rotary shaft to transmit the reduced rotating speed to the dispersion plate being intervened between the rotary shaft and the dispersion plate.

Preferred embodiments of the present invention will be described in conjunction with attached drawings.

DETAILED DESCRIPTION OF THE PREFERRED EMBODIMENTS

Figure 3:
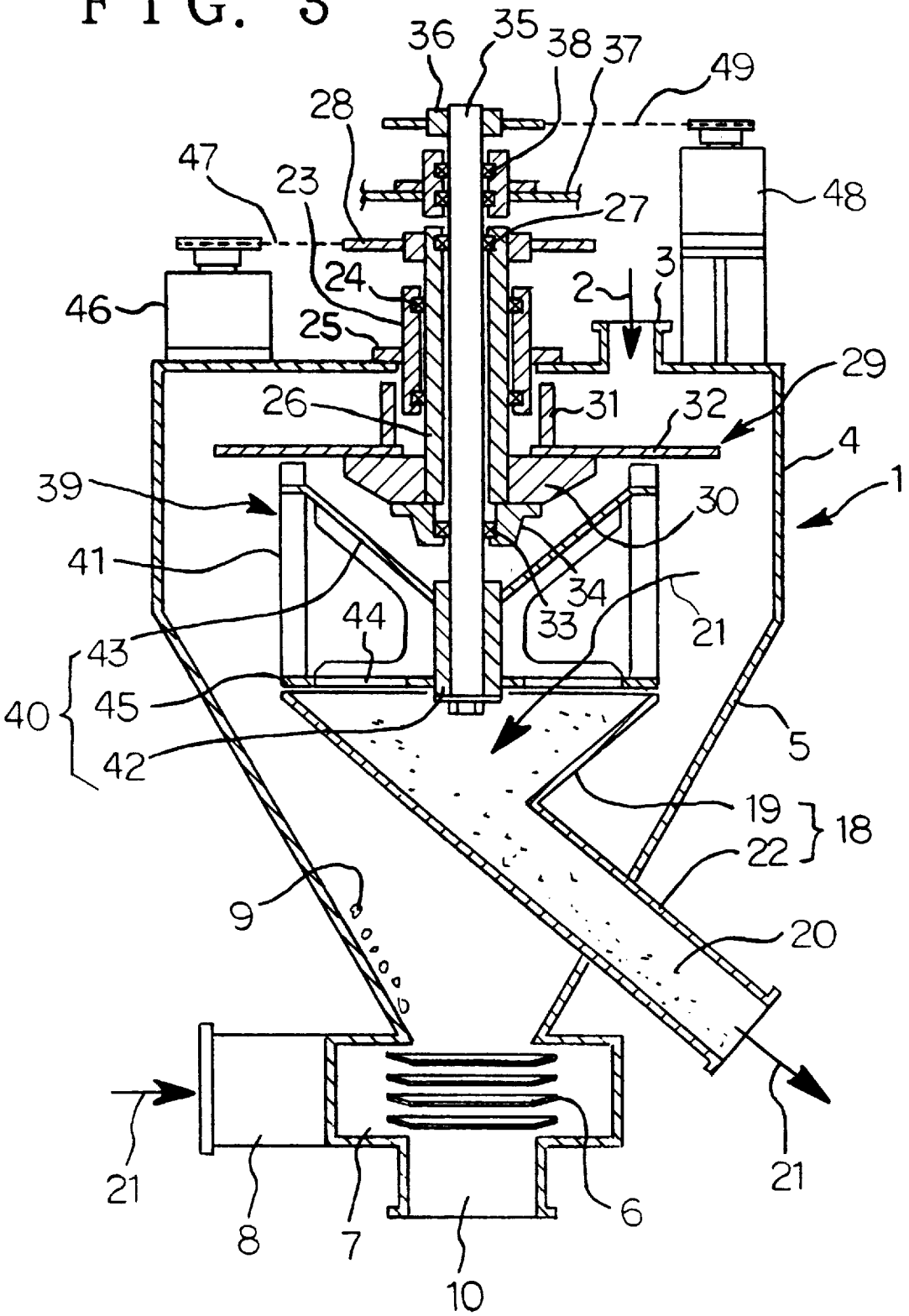
FIG. 3 is a vertical section schematically showing an embodiment of a classifier according to the present invention.

Referring to FIG. 3, reference numeral 23 denotes a hollow bearing which vertically extends through substantially a center of an upper surface of a casing 1. The hollow bearing 23 has internal roller bearings 24 on its opposite vertical ends, respectively, and a flange 25 on an intermediate portion at its outer periphery, and is fixed to the upper surface of the casing 1 through bolting or the like fastening of the flange 25.

Reference numeral 26 represents a hollow shaft which is rotatably supported by the roller bearings 24 of the hollow bearing 23 and has an internal roller bearing 27 on its upper end. A driving sprocket 28 is arranged on an outer periphery of the upper end of the hollow shaft 26 while a dispersion plate 29 is fitted over a lower end of the shaft 26.

The dispersion plate 29 comprises a boss 30 fitted over and fixed to the lower end of the hollow shaft 26 and a disk-shaped dispersion plate main body 32 fixed to an upper surface of the boss 30 and having at its central portion a cylindrical partition 31 extending immediately under the upper surface of the casing 1 so as to enclose the lower end of the hollow shaft 26. A box 34 with an internal roller bearing 33 is connected to a lower portion of the boss 30.

Reference numeral 35 represents a rotary shaft which extends through the hollow shaft 26 and which is rotatably supported by the roller bearings 27 and 33 on the upper end of the shaft 26 and on the box 34, respectively. The rotary shaft 35 has a driving sprocket 36 on an outer periphery of its upper end, is supported at its portion immediately under the sprocket 36 by internal roller bearings 38 on a structural body 37 positioned above the casing 1 and supports at its lower portion a separator main body 39.

The separator main body 39 comprises a classifying rotor 40 and a plurality of classifying blades 41 arranged on an outer periphery of the rotor 40.

The classifying rotor 40 comprises a boss 42 fitted over and fixed to a lower end of the rotary shaft 35, an upper component member 43 having its base end fixed to an upper end of the boss 42 and in the form of funnel with its diameter gradually increased upward to cover the box 34 and boss 30 of the dispersion plate 29 from below and a lower component member 45 in the form of disk with its central portion fixed to a lower end of the boss 42 and having a plurality of holes 44 peripherally of the plane.

The classifying blades 41 are positioned between outer peripheral edges of the upper and lower component members 43 and 45 of the classifying rotor 40 and are annularly spaced apart from each other with a distance, their upper and lower ends being fixed to the outer peripheral edges of the members 43 and 45, respectively.

Reference numeral 46 represents a dispersion plate drive mounted on the upper surface of the casing 1 to drive the hollow shaft 26 via a chain 47 engaged on the sprocket 28 on the upper end of the shaft 26.

Reference numeral 48 represents a separator main body drive mounted on the upper surface of the casing 1 to drive the rotary shaft 35 via a chain 49 engaged on the sprocket 36 on the upper end of the shaft 35.

Next, mode of operation of the embodiment shown in FIG. 3 will be described.

The dispersion plate drive 46 is actuated to rotate the dispersion plate 29 via the chain 47, sprocket 28 and hollow shaft 26 while the separator main body drive 48 is actuated to rotate the separator main body 36 via the chain 49, sprocket 36 and rotary shaft 35. At the same time, the classifying air 21 is introduced into the vortex chamber 7 via the introduction pipe 8 and the raw material 2 is charged by a predetermined quantity into the casing 1 through the inlet 3 on the upper surface of the casing 1.

The raw material 2 thus charged falls onto the upper surface of the dispersion plate main body 32 of the rotating dispersion plate 29 so that, with centrifugal force given to the raw material 2, the raw material 2 is dispersed peripherally outwardly of the dispersion plate main body 32.

In this case, the classifying air 21 introduced from the introduction pipe 8 into the vortex chamber 7 is given swirling force by the chamber 7 and flows into the casing 1 through the louvers 6. Thus, a flow of classifying air 21 is provided which swirls up along the inner surface of the lower casing section 5 and flows into the rotating separator main body 39 through the classifying blades 41, so that the raw material 2 falling from the dispersion plate main body 32 is dispersed into the flow of the classifying air 21.

The raw material 2 entrained on the flow of the classifying air 21 is classified into fine and crude powders 20 and 9, the fine powder 20 being the powder which is allowed to pass through the classifying blades 41 to the rotating separator main body 39 while the crude powder 9 is the powder which is not allowed to pass. Only the fine powder 20 which has passed through the classifying blades 41 is guided into the separator main body 39, flows down into the hopper main body 19 of the fine powder hopper 18 and is discharged outside together with the classifying air 21 through the exhaust outlet 22.

On the other hand, the crude powder 9 which is not allowed to pass through the classifying blades 41 and is flapped onto the inner surface of the casing 1 as well as the crude powder 9 which cannot be entrained on the flow of the classifying air 21 from the beginning are away from the flow of the classifying air 21, fall down along the inner surface of the casing 1 and are discharged outside through the lower crude powder outlet 10.

As described above, the drive system for the dispersion plate 29 is independent from the drive system of the separator main body 39, which enables the drive systems of the dispersion plate 29 and of the separator main body 39 to be controlled independently from each other. As a result, the dispersion plate 29 can be rotated at an optimums number of revolutions (10 to 100 r.p.m.) suitable for dispersion of the raw material 2 and the separator main body 39 can be rotated at an optimum number of revolutions (100 to 1000 r.p.m.) suitable for classification of the raw material 2. Because of adequate centrifugal force being given to the raw material 2 to be dispersed by the dispersion plate 29, the fine powder 20 in the raw material 2 is facilitated to be entrained on the flow of the classifying air 21 into the separator main body 39, resulting extensive improvement in classifying efficiency. Further, because of less quantity of powder striking on and falling down along the inner surface of the casing 1, wearing of the inner surface of the casing 1 can be suppressed.

Figure 4:
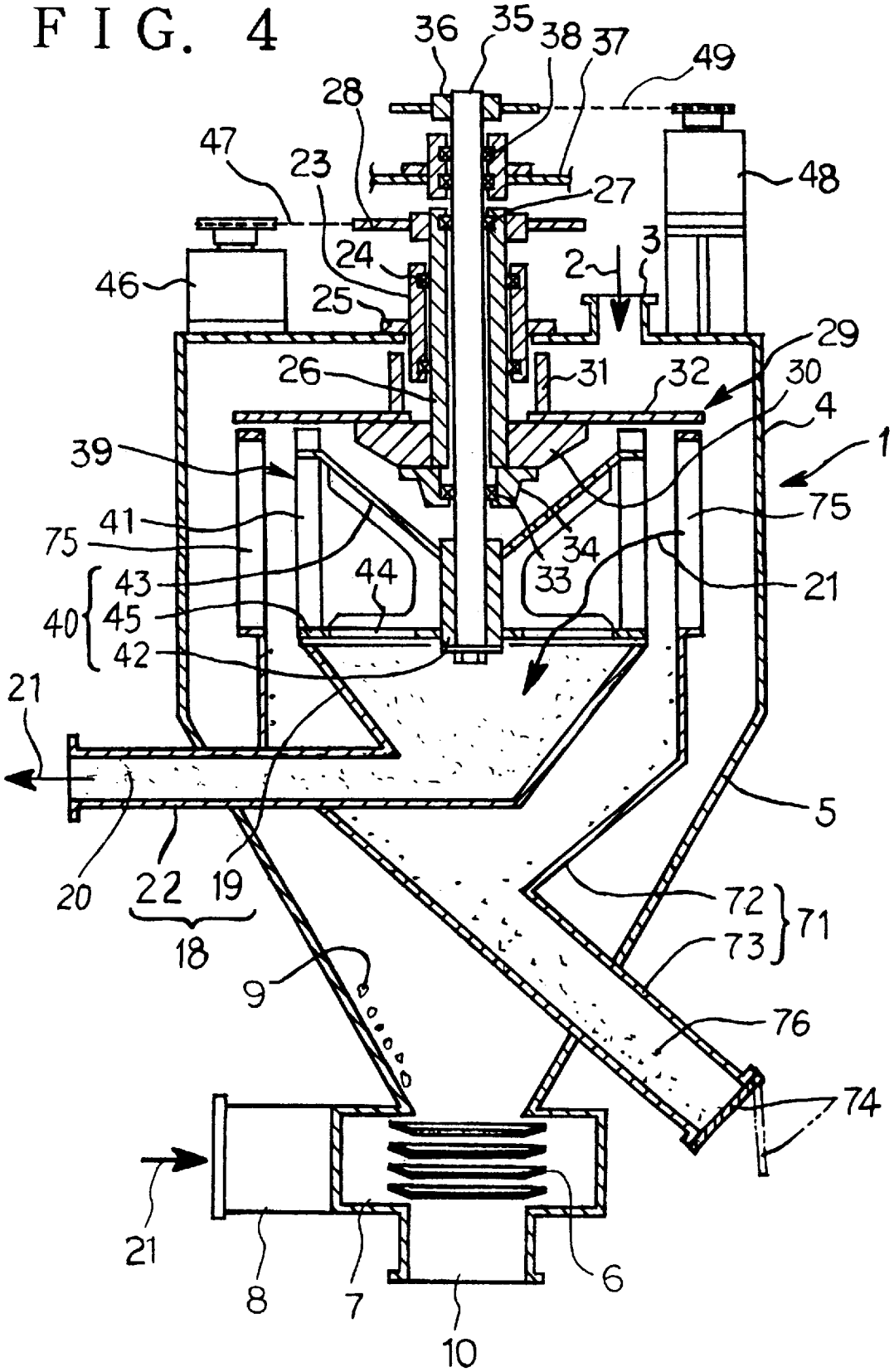
FIG. 4 is a vertical section schematically showing a further embodiment of the classifier according to the present invention.

FIG. 4 represents a further embodiment of the classifier according to the present invention in which a medium powder hopper 71 is arranged under the separator main body 39 to enclose the hopper main body 19 of the fine powder hopper 18. The exhaust outlet 22 of the fine powder hopper 18 enclosed by the medium powder hopper 71 extends horizontally through a funnel-shaped hopper main body 72 which constitutes an upper portion of the hopper 71 and through the lower casing section 5. A medium powder discharge outlet 73 which constitutes a lower portion of the medium powder hopper 71 extends downwardly from the lower end of the hopper main body 72 through the lower casing section 5 and is provided at its lower end with a damper 74 which can be selectively opened and closed. Further, the medium powder hopper 71 has at its upper end a plurality of stationary vanes 75 to annularly enclose an outer periphery of the separator main body 39.

More specifically, this classifier is a three-way classifier wherein the raw material 2 dispersed by the dispersion plate 29 is classified into crude, medium and fine powders 9, 76 and 20, the crude powder 9 being the powder which cannot be entrained on the flow of the classifying air from the beginning, the medium powder 76 being the powder which has passed through the stationary vanes 75 while entrained on the classifying air 21 and is not allowed to pass through the classifying blades 41 of the separator main body 39, the fine powder 20 being the powder which is allowed to pass through the classifying blades 41. The crude powder 9 is discharged through the crude powder discharge outlet 10 at the lower end of the lower casing section 5; the medium powder 76 is discharged through the medium powder discharge outlet 73 of the medium powder hopper 71; and the fine powder 20 is discharged through the exhaust outlet 22 of the fine powder hopper 18 together with the classifying air 21. With respect to such three-way classifier, provision of the dispersion plate 29 which can be driven at number of revolutions different from that of the separator main body 39 is much meaningful.

Because, it is very much difficult to realize a three-way classifier for classifying the raw material 2 into crude, medium and fine powders 9, 76 and 20 with the dispersion plate 29 and separator main body 39 being driven at the same number of revolutions. For example, as shown in Table 1 below, when classification is made with the dispersion plate 29 and separator main body 39 being driven at the same number of revolutions (200 to 250 r.p.m.) required for classification and ratio of crude particles with diameter of 4.76 mm or more in the powder withdrawn as medium powder 76 is to be suppressed to be on the order of 0.3%, air volume unit requirement or consumption (volume of classifying air/amount of raw material supplied) will be on the order of 0.46 $m^3$/kg; however, in this case, the powder withdrawn as crude powder 9 amounts to 79.1% of the raw material 2. This means that most of the raw material 2 is dealt with as crude powder 9.

When the classification air volume is increased to increase air volume unit requirement into 1.29 $m^3$/kg so as to prevent fine particles from being included in the powder withdrawn as crude power 9, the amount of the powder withdrawn as crude powder 9 is lowered to 44.7% of the raw material 2. However, the ratio of crude particles with diameter of 4.76 mm or more in the powder withdrawn as medium powder 76 is worsened into 2.9%.

When the classification air volume unit requirement is further increased into 2.16 $m^3$/kg, then the amount of the powder withdrawn as crude powder 9 is further lowered into 22.6% of the raw material 2. However, the ratio of crude particles with diameter of 4.76 mm or more in the powder withdrawn as medium powder 76 is worsened into 6.2%.

TABLE 1

| | (1) | (2) | (3) |
|---|---|---|---|
| Air volume unit requirement ($m^3$/kg) | 0.46 | 1.29 | 2.16 |
| Ratio of powder withdrawn as crude powder to raw material (%) | 79.1 | 44.7 | 22.6 |
| Ratio of particles with diameter of 4.76 mm or more in powder withdrawn as medium powder | 0.3 | 2.9 | 6.2 |

Thus, in a three-way classifier, when the dispersion plate 29 and the separator main body 39 are rotated at the same number of revolutions required for classification, withdrawal of medium powder 76 with no crude particles being included cannot be attained concurrently with withdrawal of crude powder 9 with no fine particles being included.

In general, the less the air volume unit requirement is, the more the burden on capabilities of surrounding facilities is lessened. In practical use, it is preferred that the air volume unit requirement is on the order of 0.55 to 0.58 $m^3$/kg. With the dispersion plate and the separator main body being rotated at the same number of revolutions, this will result in the powder withdrawn as crude powder 9 amounting to 73 to 76% of the raw material 2, the ratio of crude particles with diameter of 4.76 mm or more in the powder withdrawn as medium powder 76 being 0.4 to 0.6%.

By contrast, when the classification is made under conditions that the number of revolutions of the dispersion plate 29 is reduced to be on the order of one-fifth or one-sixth (about 40 r.p.m.) of the number of revolutions (200 to 250 r.p.m.) of the separator main body 39 and the air volume unit requirement is made to be 0.55 to 0.58 $m^3$/kg, then extremely good result is obtained in which the powder withdrawn as crude powder 9 is 16 to 30% of the raw material 2 and the ratio of crude particles with diameter of 4.76 mm or more in the powder withdrawn as medium powder 76 is 0.01 to 0.2%.

Figure 5:
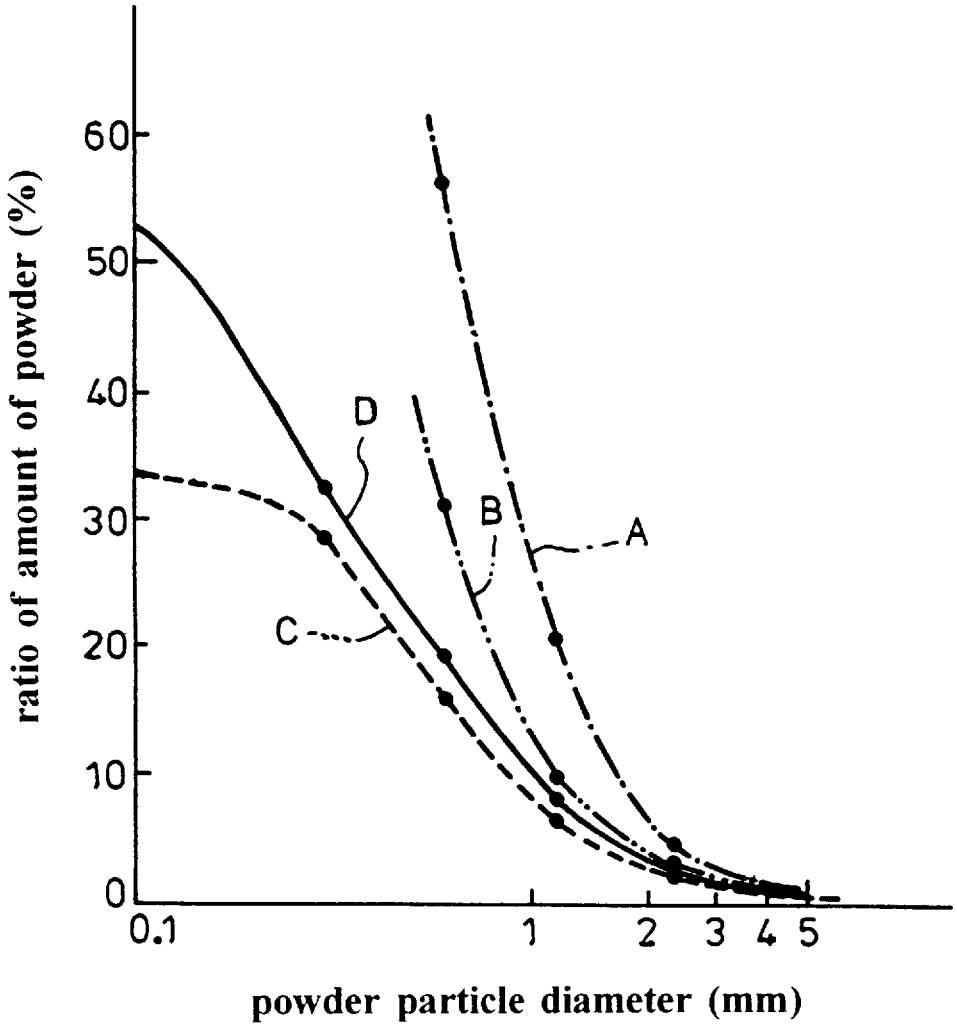
FIG. 5 is a diagram showing particle size distribution of powder withdrawn as crude powder.

FIG. 5 is a diagram which shows actual results on particle size distribution of the powder withdrawn as crude powder 9. In the present invention, when classification was made with the air volume unit requirement being 0.58 $m^3$/kg, particle size distribution as shown in curve A was obtained and the powder withdrawn as crude powder 9 was confirmed to actually include no fine particles.

In FIG. 5, curve B indicates a particle size distribution when, in the present invention, classification was made with the air volume unit requirement being 0.55 $m^3$/kg; and curve C indicates a particle size distribution when classification was made with the air volume unit requirement being 0.58 $m^3$/kg and with the dispersion plate 29 and separator main body 39 being rotated at the same number of revolutions (200 to 250 r.p.m.) required for classification. Curve D shows particle size distribution of the raw material 2 itself.

Therefore, with respect to a three-way classifier, when the dispersion plate 29 can be rotated at number of revolutions different from that of the separator main body 39, then withdrawal of the medium powder 76 with no inclusion of crude particles can be attained concurrently with withdrawal of the crude powder 9 with no inclusion of fine particles, which drastically improves practicability of the three-way classifier.

Figure 6:
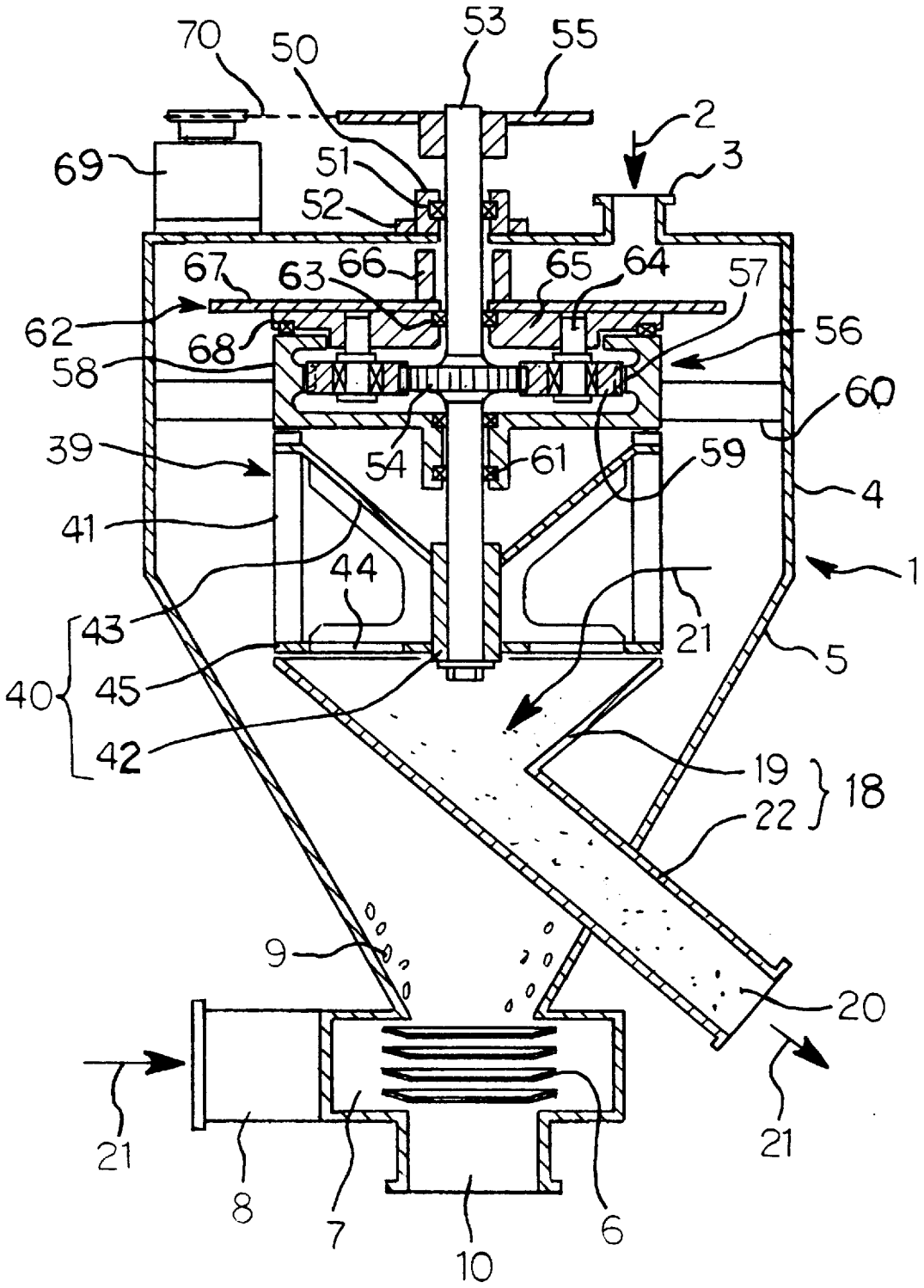
FIG. 6 is a vertical section schematically showing a still further embodiment of the classifier according to the present invention.

FIG. 6 is a vertical sectional view schematically showing a still further embodiment of the classifier according to the present invention. The same components as in FIGS. 3 and 4 are referred to by the same reference numerals and detailed description therefor is omitted.

Reference numeral 50 denotes a vertical bearing with an inner roller bearing 51. The vertical bearing 50 has a flange 52 on its outer periphery which is fixed substantially to a center of the upper surface of the casing 1 by bolting or the like fastening.

Figure 1:
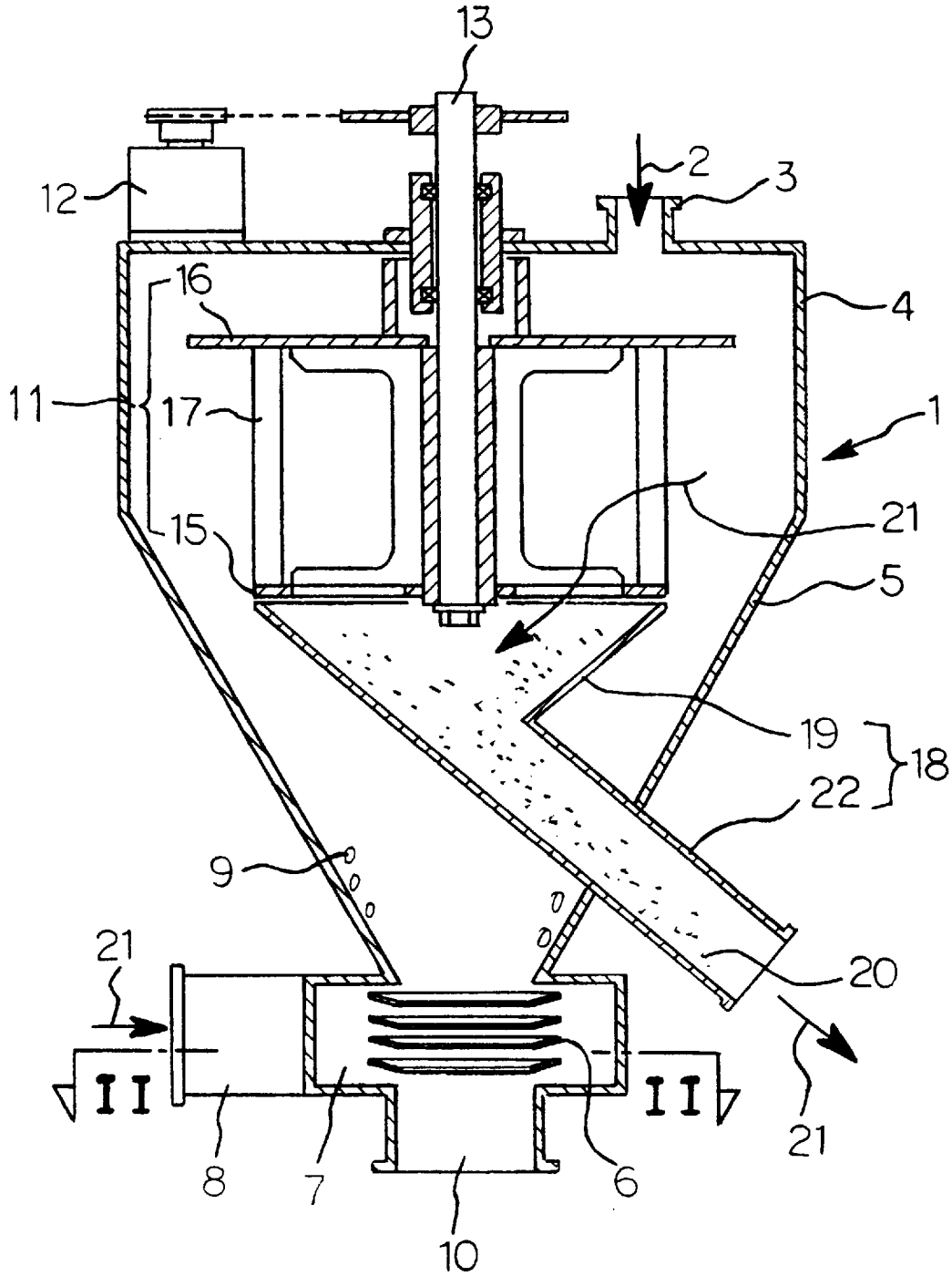
FIG. 1 PRIOR ART
FIG. 1 is a vertical section schematically showing a conventional classifier.
Figure 2:
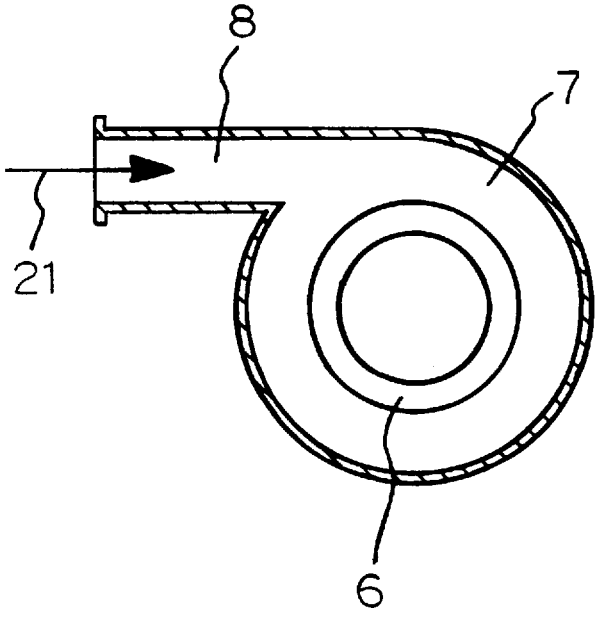
FIG. 2 PRIOR ART
FIG. 2 is a view taken along lines II—II in FIG. 1.

Reference numeral 53 represents a rotary shaft which is supported by the roller bearing 51 of the vertical bearing 50 and which extends down vertically into the casing 1 through the upper surface of the casing 1. The rotary shaft 53 has a gear 54 on its longitudinally intermediate portion. A driving sprocket 55 is fitted over an upper end of the rotary shaft 53 extruding from the vertical bearing 50 and the same separator main body 39 as shown in FIG. 1 is supported by a lower end of the shaft 53.

Reference numeral 56 designates a speed reducing mechanism which comprises a housing 58 having an internal gear 57 formed on its inner periphery and a planetary gear 59 engaged with the gear 57. The speed reducing mechanism 56 is arranged in the casing 1 such that a gear 54 provided on and concentric with the rotary shaft 53 is in mesh with the planetary gear 59, and is fixed to the casing 1 by a plurality of support members 60 extending radially from an outer periphery of the housing 58.

A lower surface of the housing 58 is mutually rotatably connected at its center portion with the rotary shaft 53 via roller bearings 61.

Reference numeral 62 represents a dispersion plate which comprises a boss 65 rotatably fitted via an inner roller bearing 63 over the rotary shaft 53 immediately above the gear 54 on the shaft 53 and connected via pins 64 to the planetary gear 59 and a disk-shaped dispersion plate main body 67 fixed to an upper surface of the boss 65 and having a cylindrical partition 66; extending immediately under the upper surface of the casing 1 so as to enclose the rotary shaft 53. The outer periphery of the boss 65 abuts at its lower surface, via a roller bearing 68, on the upper surface of the housing 58.

Reference numeral 69 denotes a drive mounted on the upper surface of the casing 1 to drive the rotary shaft 53 via a chain 70 engaged on the sprocket 55 on the upper end of the shaft 53.

When the drive 69 is actuated to rotate the separator main body 39 via the chain 70, sprocket 55 and rotary shaft 53 and to synchronously drive the planetary gear 59 for rotation along the internal gear 57 by the gear 54 of the rotary shaft 53, the dispersion plate 62 connected via the pins 64 to the planetary gear 59 is rotated. At the same time, the classifying air 21 is introduced via the introduction pipe 8 into the vortex chamber 7 and the raw material 2 is charged by a predetermined quantity into the casing 1 through the inlet 3 on the upper surface of the casing 1.

The raw material 2 thus charged falls onto the upper surface of the dispersion plate main body 67 of the rotating dispersion plate 62 so that, with centrifugal force given to the raw material 2, the raw material 2 is dispersed peripherally outwardly of the dispersion plate main body 67.

In this case, the classifying air 21 introduced from the introduction pipe 8 into the vortex chamber 7 is given swirling force by the chamber 7 and flows into the casing 1 through the louvers 6. Thus, a flow of classifying air 21 is provided which swirls up along the inner surface of the lower casing section 5 and flows into the rotating separator main body 39 through the classifying blades 41, so that the raw material 2 falling from the dispersion plate main body 32 is dispersed into the flow of the classifying air 21.

The raw material 2 entrained on the flow of the classifying air 21 is classified into fine and crude powders 20 and 9, the fine powder 20 being the powder which is allowed to pass through the classifying blades 41 while the crude powder 9 is the powder which is not allowed to pass. Only the fine powder 20 which has passed through the classifying blades 41 is guided into the separator main body 39, flows down into the hopper main body 19 of the fine powder hopper 18 and is discharged outside together with the classifying air 21 through the exhaust outlet 22.

On the other hand, the crude powder 9 which is not allowed to pass through the classifying blades 41 and is flapped onto the inner surface of the casing 1 as well as the crude powder 9 which cannot be entrained on the flow of the classifying air 21 from the beginning are away from the flow of the classifying air 21, fall down along the inner surface of the casing 1 and are discharged outside through the lower crude powder discharge outlet 10.

As described above, the speed reducing mechanism 56 is intervened between the drive system of the separator main body 39 and the drive system of the dispersion plate 62. Accordingly, by properly selecting speed reduction ratio of the speed reducing mechanism 56, on the basis of an optimal number of revolutions (100 to 1000 r.p.m.) of the separator main body 39 required for classification of the raw material 2, the number of revolutions of the dispersion plate 62 can be set to optimal number of revolutions (10 to 100 r.p.m.) required for dispersion of the raw material 2. Because of adequate centrifugal force being given to the raw material 2 to be dispersed by the dispersion plate 62, the fine power 20 in the raw material 2 is facilitated to be entrained on the flow of the classifying air 21 into the separator main body 39, resulting in extensive improvement in classifying efficiency. Further, because of less quantity of powder striking on and falling down along the inner surface of the casing 1, wearing of the inner surface of the casing 1 can be suppressed. Furthermore, the operation may be made with the single drive 69.

It is to be understood that the classifier according to the present invention is not limited to the above embodiments and that various changes and modifications may be made without departing from the spirit and the scope of the present invention. For example, various shapes and structures may be adopted with respect to the casing or the means for discharging the fine powder which is introduced through the classifying blades into the separator main body. A speed reducing mechanism between the drive system of the separator main body and the drive system for the dispersion plate may be applied to the three-way classifier as shown in FIG. 4.

What is claimed is:

1. In a classifier wherein a raw material is dispersed around a rotating separator main body within a casing, the rotating separator main body having a plurality of classifying blades annularly arranged thereon and is exposed on a rising flow of classifying air so as to sift off crude powder which cannot be entrained on the flow of the classifying air, the remaining raw material entrained on said classifying air being peripherally introduced into said separator main body for classification into fine and crude powder, the fine powder being the powder which is allowed to pass through the classifying blades while the crude powder is the powder which is not allowed to pass, an improvement which comprises a dispersion plate arranged between said separator main body and a raw material inlet above said separator main body for receiving and dispersing the raw material from said inlet, said dispersion plate being rotatable at number of revolutions different from that of the separator main body; and means for introducing the rising flow of classifying air as the only flow of classifying air within the casing.

2. A classifier according to claim 1 wherein the dispersion plate is supported from above by a hollow shaft and the separator main body is supported by a rotary shaft which rotatably extends through the hollow shaft, the hollow and rotary shafts being driven by independent drives, respectively.

3. A classifier according to claim 1 wherein the separator main body is supported from above by a rotary shaft driven by a drive and the dispersion plate is rotatably fitted over an intermediate portion of the rotary shaft at a position above the separator main body, a speed reducing mechanism for reducing rotating speed given to the rotary shaft to transmit the reduced rotating speed to the dispersion plate being intervened between the rotary shaft and the dispersion plate.

4. A classifier according to claim 1, wherein the means for introducing the classifying air comprises a vortex chamber.

5. A classifier according to claim 4, wherein the vortex chamber comprises louvers.

6. In a classifier wherein a raw material is dispersed around a rotating separator main body within a casing, the rotating separator main body having a plurality of classifying blades annularly arranged thereon and having a plurality of stationary vanes surrounding the separator main body and is exposed on a rising flow of classifying air so as to sift off crude powder which cannot be entrained on the flow of the classifying air, the remaining raw material entrained on said classifying air being peripherally introduced through the stationary vanes into said separator main body for classification into fine and crude powders, the fine powder being the powder which is allowed to pass through the classifying blades while the crude powder is the powder which is not allowed to pass, an improvement which comprises a dispersion plate arranged between said separator main body and a raw material inlet above said separator main body for receiving and dispersing the raw material from said inlet, said dispersion plate being rotatable at number of revolutions different from that of the separator main body; and means for introducing the rising flow of classifying air as the only flow of classifying air within the casing.

7. A classifier according to claim 6 wherein the dispersion plate is supported from above by a hollow shaft and the separator main body is supported by a rotary shaft which rotatably extends through the hollow shaft, the hollow and rotary shafts being driven by independent drives, respectively.

8. A classifier according to claim 6 wherein the separator main body is supported from above by a rotary shaft driven by a drive and the dispersion plate is rotatably fitted over an intermediate portion of the rotary shaft at a position above the separator main body, a speed reducing mechanism for reducing rotating speed given to the rotary shaft to transmit the reduced rotating speed to the dispersion plate being intervened between the rotary shaft and the dispersion plate.

9. A classifier according to claim 6, wherein the means for introducing the classifying air comprises a vortex chamber.

10. A classifier according to claim 9, wherein the vortex chamber comprises louvers.

* * * * *